US011414244B2

(12) United States Patent
Gosling et al.

(10) Patent No.: US 11,414,244 B2
(45) Date of Patent: Aug. 16, 2022

(54) SYSTEM AND METHOD FOR CONNECTING MEMBERS

(71) Applicant: Cheer Pack North America, West Bridgewater, MA (US)

(72) Inventors: Stephen Gosling, Hingham, MA (US); David A. Williamson, Plymouth, MA (US)

(73) Assignee: Cheer Pack North America, West Bridgewater, MA (US)

( * ) Notice: Subject to any disclaimer, the term of this patent is extended or adjusted under 35 U.S.C. 154(b) by 0 days.

(21) Appl. No.: 17/084,245

(22) Filed: Oct. 29, 2020

(65) Prior Publication Data

US 2022/0135286 A1 May 5, 2022

(51) Int. Cl.
*B65D 41/34* (2006.01)
*B65D 75/58* (2006.01)

(52) U.S. Cl.
CPC ..... *B65D 41/3404* (2013.01); *B65D 41/3433* (2013.01); *B65D 75/5883* (2013.01); *B65D 2401/00* (2020.05)

(58) Field of Classification Search
CPC ..... B65D 41/3404; B65D 41/3433; B65D 75/5883; B65D 2401/00
USPC ..... 220/288, 23.4; 446/124, 127; D9/436, D9/435
See application file for complete search history.

(56) References Cited

U.S. PATENT DOCUMENTS

| | | | | |
|---|---|---|---|---|
| 3,086,629 | A * | 4/1963 | Blitzer | E06B 9/01 52/799.1 |
| D230,013 | S | 1/1974 | Emerson | |
| D294,458 | S | 3/1988 | Wilmott et al. | |
| 4,764,143 | A * | 8/1988 | Gat | A63H 33/105 446/102 |
| D322,025 | S * | 12/1991 | Funston | D8/382 |
| D547,657 | S | 7/2007 | Tacchella | |
| D562,683 | S | 2/2008 | Sweeton et al. | |
| D600,120 | S | 9/2009 | Kawamura | |
| D637,080 | S | 5/2011 | Brooks | |
| D679,597 | S | 4/2013 | Tamarindo | |
| D681,460 | S | 5/2013 | Kim | |
| D682,688 | S | 5/2013 | Murray | |

(Continued)

FOREIGN PATENT DOCUMENTS

| | | | |
|---|---|---|---|
| CN | 206255377 | U | 6/2017 |
| KR | 101924434 | B1 | 12/2018 |
| WO | 2020037788 | A1 | 2/2020 |

OTHER PUBLICATIONS

Cheer Pack Caps: Announced Jun. 8, 2019 [online]. Site Visited [Dec. 13, 2021]. Available from Internet URL: http:// cheerpack.com/index.php/capabilities/products/.

(Continued)

*Primary Examiner* — J. Gregory Pickett
*Assistant Examiner* — Niki M Eloshway
(74) *Attorney, Agent, or Firm* — Harness, Dickey & Pierce, P.L.C.

(57) ABSTRACT

Disclosed is a multiple purpose connectable member. The connectable member may be used and operated to seal or close a container. The connectable member may further be operated to connect a plurality of the connectable members together. A plurality of the connectable members may be connected in various combinations and/or geometries.

19 Claims, 10 Drawing Sheets

(56) References Cited

U.S. PATENT DOCUMENTS

| | | | | |
|---|---|---|---|---|
| 8,443,999 | B1 * | 5/2013 | Reinders | B65D 41/0485 220/303 |
| D684,055 | S | 6/2013 | Kwon | |
| D684,056 | S | 6/2013 | Kwon | |
| D684,057 | S | 6/2013 | Kwon | |
| D693,220 | S | 11/2013 | Luo | |
| D705,061 | S | 5/2014 | Jo et al. | |
| D705,062 | S | 5/2014 | Jo et al. | |
| D717,650 | S | 11/2014 | Tamarindo | |
| D735,038 | S | 7/2015 | Tamarindo | |
| D751,397 | S | 3/2016 | Kim | |
| D759,486 | S | 6/2016 | Ingram et al. | |
| D770,281 | S | 11/2016 | Kim | |
| D775,952 | S | 1/2017 | Kim | |
| D796,326 | S | 9/2017 | Ichikawa et al. | |
| 9,975,659 | B2 * | 5/2018 | McConnell | B65D 81/361 |
| D819,442 | S * | 6/2018 | Johnson | D9/435 |
| D823,115 | S | 7/2018 | Walker et al. | |
| D830,522 | S | 10/2018 | Di Liberto | |
| D842,698 | S | 3/2019 | Moriyama et al. | |
| D842,699 | S | 3/2019 | Tamarindo | |
| D843,215 | S | 3/2019 | Steigelman | |
| 10,472,133 | B2 | 11/2019 | Tamarindo | |
| D871,832 | S | 1/2020 | Marina et al. | |
| D872,528 | S | 1/2020 | Hsu | |
| D897,207 | S | 9/2020 | Marino | |
| D905,072 | S | 12/2020 | Buzzi | |
| D906,108 | S | 12/2020 | Kwon | |
| D915,197 | S | 4/2021 | Katano et al. | |
| 2004/0000550 | A1 * | 1/2004 | Taccolini | A47J 47/16 220/23.4 |
| 2012/0211460 | A1 * | 8/2012 | Tamarindo | B65D 41/0485 215/228 |
| 2013/0175274 | A1 | 7/2013 | Kim | |
| 2013/0213927 | A1 * | 8/2013 | Hendrickson | E04H 1/005 215/383 |
| 2015/0144362 | A1 * | 5/2015 | Thompson | E01H 12/00 171/107 |
| 2015/0144632 | A1 | 5/2015 | Tamarindo et al. | |
| 2016/0272380 | A1 * | 9/2016 | Mazurkiewicz | B65D 75/5883 |
| 2018/0170626 | A1 * | 6/2018 | Kwon | B65D 41/3404 |

OTHER PUBLICATIONS

Dow Flexible Packaging Caps: Announced Oct. 3, 2016 [online]. Site Visited [Dec. 13, 2021]. Available from Internet U R L: https ://www.flexpackmag.com/articles/88386-i n novative-closu re-resi ns-by-dow-offer-resou rce-for -cap-and-closure-technology.

Extended European Search Report regarding Application No. 21205475. 3, dated Apr. 4, 2022.

* cited by examiner

SYSTEM AND METHOD FOR CONNECTING MEMBERS

CROSS-REFERENCE TO RELATED APPLICATIONS

This application includes subject matter similar to that disclosed in concurrently filed U.S. application Ser. No. 29/756,622. The entire disclosure of the above application is incorporated herein by reference.

FIELD

The disclosure relates to a container cap, in particularly to a connectable container cap.

BACKGROUND

This section provides background information related to the present disclosure which is not necessarily prior art.

A container may generally include at least an opening for filling or removing material from the container. The opening may often be closed with a closing member such as a cap or closure mechanism. The cap may be selectively connected and disconnected from the container. The cap may also be permanently removed from the container such that it cannot be replaced. The cap, however, is generally provided specifically for closing a container.

SUMMARY

This section provides a general summary of the disclosure, and is not a comprehensive disclosure of its full scope or all of its features.

Disclosed is a system and method for a cap assembly and interconnection thereof. In particular, the cap assembly may include portions that allow for interconnection of a plurality of caps to one another. Therefore, the caps may engage or close a container and/or interconnect with one another.

In various embodiments, the caps may include projections and slots that allow for a selected connection of the caps. The projection may be received within a slot and engage a wall portion of the cap at the slot to allow for an engagement of the cap. Further, the cap may be engaged axially or vertically to another cap to allow for interconnection of a cap in a three-dimensional configuration.

The caps may further engage a container to close the container. The caps may sealingly engage the container and include a seal and/or tamper resistant or evident feature(s). The cap may operate in a plurality of manners including closing a container, interacting with other caps and/or combinations thereof.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
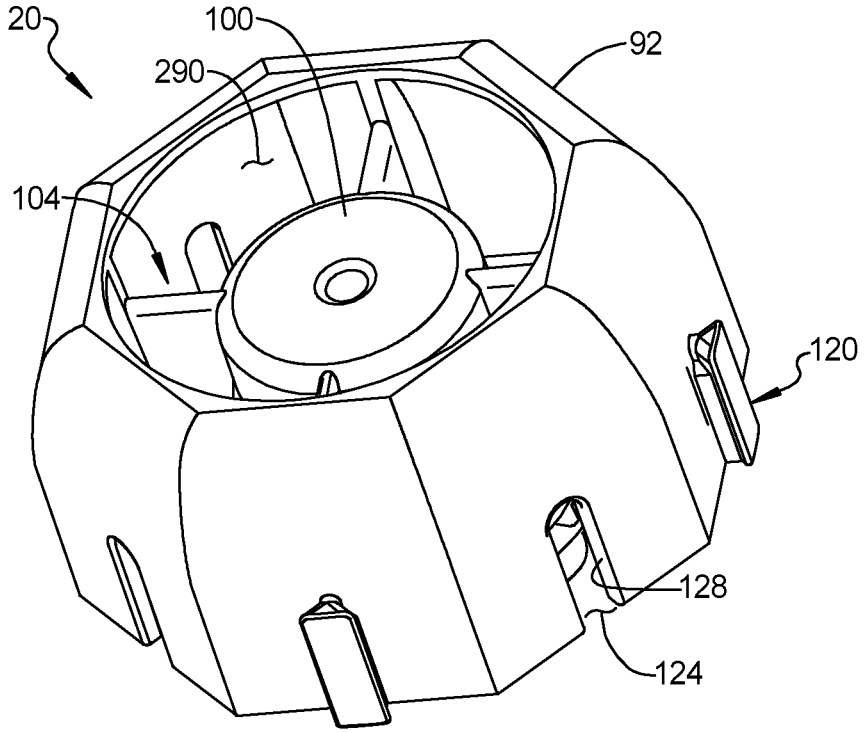
FIG. 1 is a top perspective view of a cap, according to various embodiments.
Figure 2:
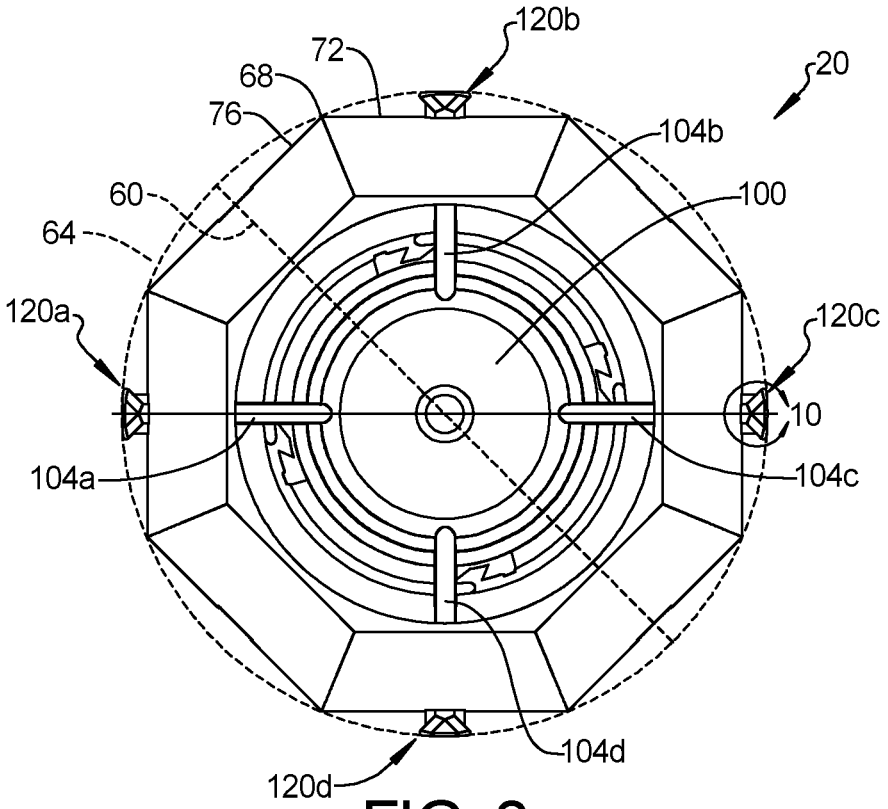
FIG. 2 is a top plan view of the cap of FIG. 1.
Figure 3:
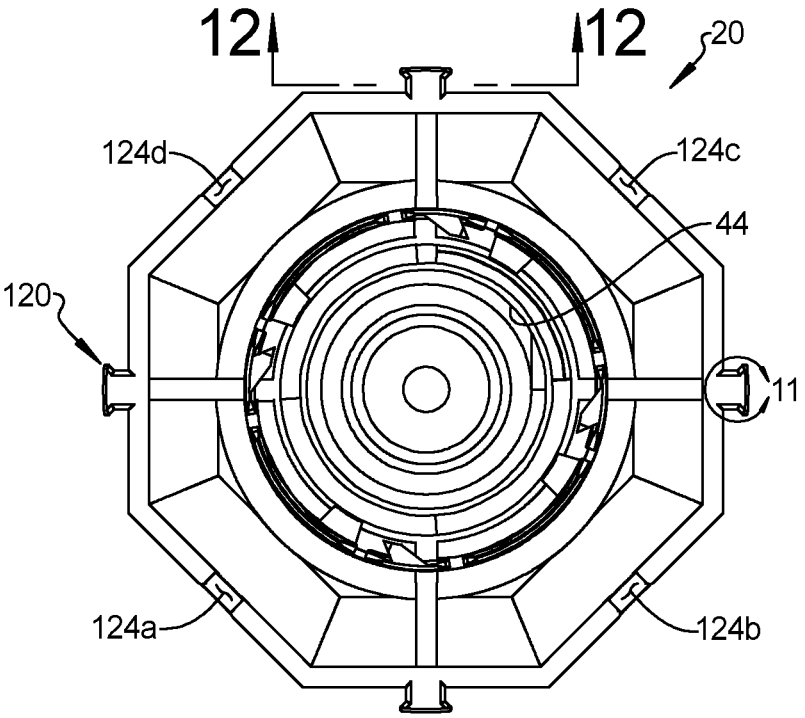
FIG. 3 is a bottom plan view of the cap of FIG. 1.
Figure 4:
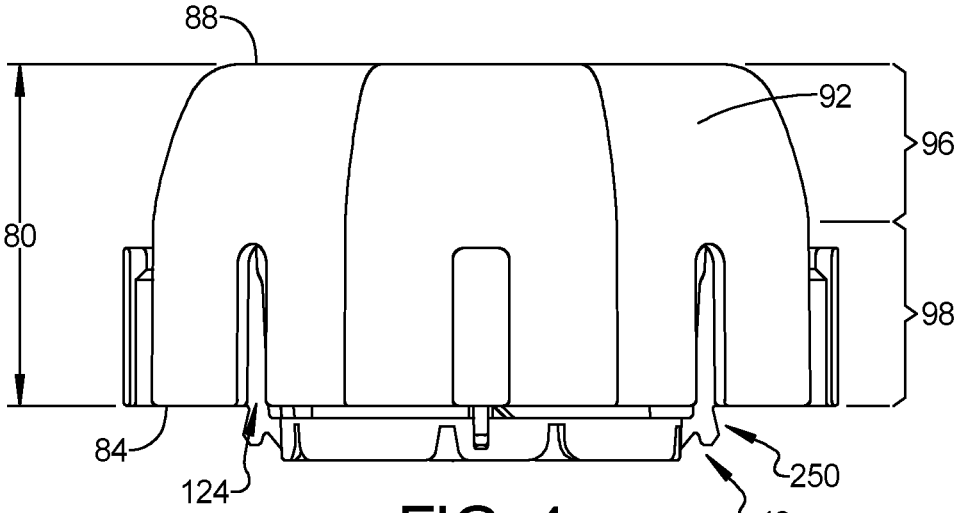
FIG. 4 is a side elevation view of cap of FIG. 1.
Figure 5:
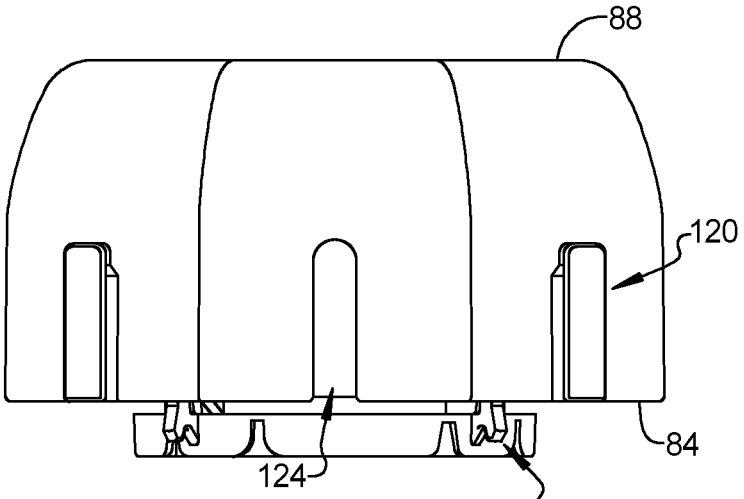
FIG. 5 is a second side elevation view of cap of FIG. 1.
Figure 6:
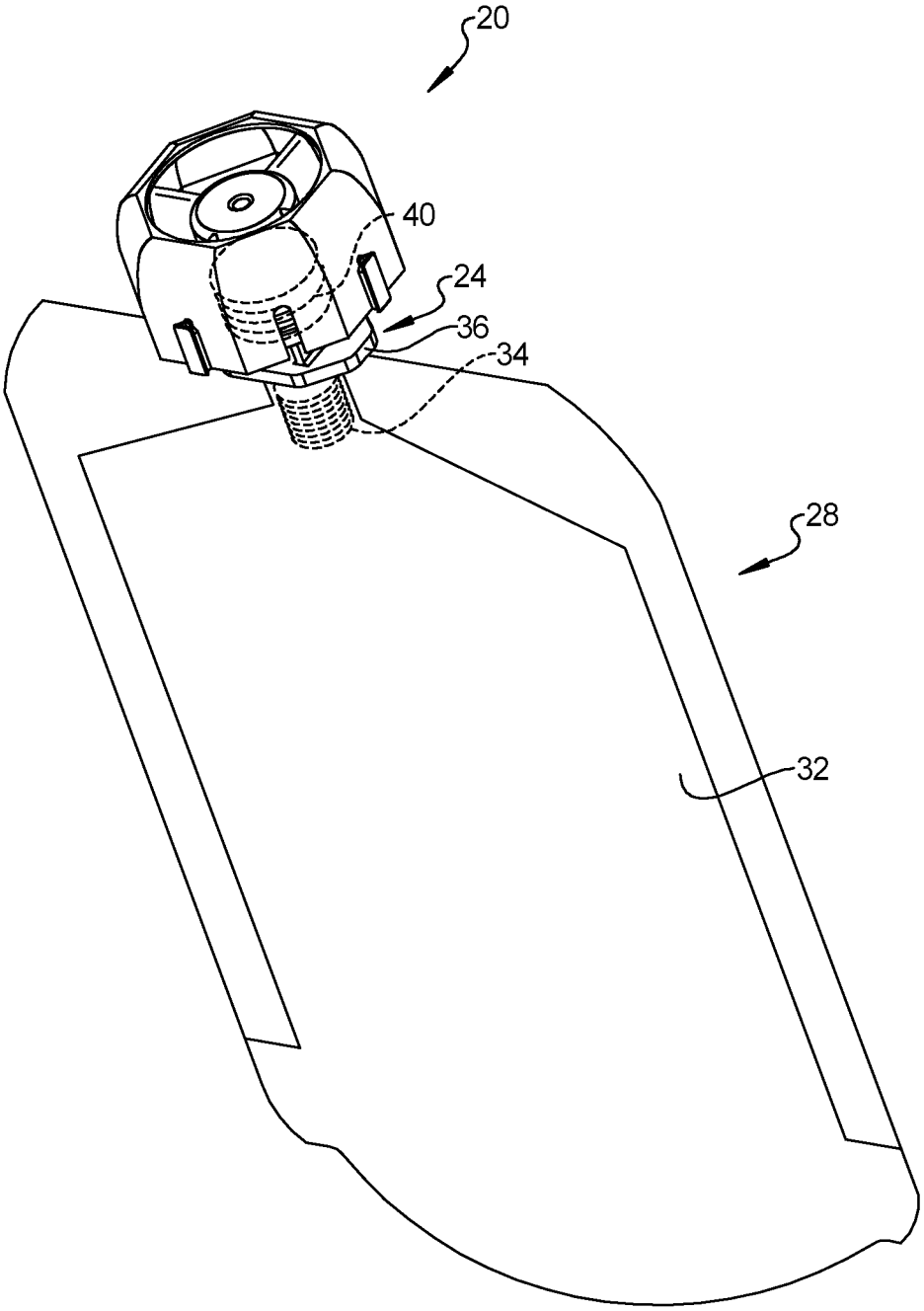
FIG. 6 is an environmental view of the cap connected to a container, according to various embodiments.

Example embodiments will now be described more fully with reference to the accompanying drawings.

With initial reference to FIGS. 1-6, a cap 20 is illustrated. The cap 20 may be used to connect with a fitment 24 of a container assembly or portion 28. The container 28 may be any appropriate type of container, such as a solid wall container, a cylindrical container, a flexible wall container (e.g., a pouch), or other appropriate container. In various embodiments, for example, the container 28 may include a flexible sidewall 32 that is sealed or fixed to the fitment 24 at a container engaging portion 34. The fitment 24 may generally include rigid features or portions, such as a collar 36, and an externally threaded portion 40 that engages an internally threaded portion 44 of the cap member 20.

In various embodiments, the cap member 20 may include a sealing or tamper resistant or evident portion 48. The tamper resistant or evident portion 48 may include those disclosed in U.S. Pat. No. 9,187,217 and 10,232,985, and United States Publication No. 2019-0202605, each incorporated herein by reference. Generally, the tamper resistant or evident portion 48 may allow the cap 20 to be fixed or locked to the fitment 24 at a selected time, such as immediately or soon after filling the container 28. At a selected time, an end user may open or break the tamper resistant portion 48 to access the contents of the container 28. The tamper resistant portion 48 may also be used to provide a visual indication that the container 28 has been opened. Accordingly, the sealing or tamper evident portion 48 may be used to fix the cap 20 to the container 28 and/or provide evidence of the seal of the cap 20 to the container 28 to being open or broken.

The cap 20, and the various portions thereof, may be formed in a selected manner. In various embodiments, the cap 20 may be formed as a single member in a selected molding process. For example, the cap 20 may be molded as a single member in an injection molding process. The cap 20 may be formed of selected materials, such as those that may be selectively injection molded in a mold to form the cap 20. For example, the cap 20 may be formed of one or more of polyethylene, polypropylene, or combinations thereof. Thus, the cap 20 may be molded of a selected material, as those discussed above, and assembled to the container 28.

The cap 28 may be provided in various configurations or shapes including a generally octagon shape, as exemplary illustrated in FIG. 1. It is understood, however, that the shape of the cap 20 may be provided in any appropriate shape such as hexagonal, circular, oval, or the like. The geometry or shape of the cap 20 may include an external or major diameter 60 that defines an external or major circumference 64. Generally, the major circumference 64 may be defined at edges or junctions 68 of planar faceted portions, such as the first facet 72 and a second facet 76. The number of facets may define the outer shape or geometry (e.g., 8 facets may define a generally octagon shape for the cap 20). The major circumference 64 may also encircle a projection or locking tab 120. The diameter 60 may be any appropriate diameter, such as about 25 millimeter (mm) to about 45 mm, including about 28 mm to about 35 mm, and further including about 33 mm. Accordingly, the major diameter 60 of the cap 20 may include selected dimensions. Further, the cap 20 may include a selected height 80 from a bottom wall or surface 84 to a top wall or surface 88. The height 80 may be any appropriate height, such as about 10 mm to about 20 mm, including about 12 mm to about 18 mm, and further including about 16 mm.

The cap 20 may include an outer wall portion 92 that also defines at least a portion of the diameter 60 and/or the height 80. The wall portion 92 may include a selected shape or feature, such as including a first curved portion or region 96 and a second flat or planar region 98. It is understood, however, that the outer wall 92 may have any appropriate shape or geometry, as discussed further here in.

The cap 20 may further include various additional features. Additional features may include an internal enclosed portion or member 100 that may define or form the internal threads 44. The internal region 100 may engage the fitment 20 at the external threads 40 to seal the container 28. The outer wall 92 may define or form a graspable portion or feature that may be grasped by a user to thread or unthread the cap 20 from the container 28. In various embodiments, the cap 20 may also be assembled on to the container 28 with a selected mechanism, such as a robotic assembling mechanism that may also engage the outer wall 92.

The inner portion 100 and the outer wall 92 may be interconnected with one or more spokes or fingers 104. As illustrated herein, for example in FIG. 1 and FIG. 2, a plurality of these spokes, 104 may be included, such as four radially extending spokes 104*a*, 104*b*, 105*c*, and 104*d*. It is understood that any appropriate number of the spokes 104, however, may be provided between the central portion 104 and the outer wall 92. Generally, the outer wall 92 may be formed as a single layer portion, however, it is understood the outer wall 92 may be a double wall configuration. Further, the spokes or projections 104 may include various portions, such as surfaces or facets, which are only planar. Thus, the spokes 104 may include portions that do not extend substantially only normal to a surface of the central portion 100. Nevertheless, the spokes 104 may connect to the outer wall 92 and the inner region 100 to allow for opening and closing of the container 28 by rotating the central region 100 by grasping the outer wall 92.

Extending from the outer wall 92 may be a selected number of projections or locking fingers or tabs 120. The projections 120 may generally extend radially from a center of the cap 20. In various embodiments, for example, the cap 20 may be octagonal and every other facet or portion includes one of the projections 120. Accordingly, as exemplary illustrated in FIGS. 2 and 3, the cap 20 may include four of the projections designated 120*a*, 120*b*, 120*c*, 120*d*. Each of the projections 120 may be used to selectively engage a locking portion or region of an additional one of the caps 20, as discussed further in. Accordingly, the cap 20 may also include a locking portion or region, such as a slot or passage 124 defined through the outer wall 92. The locking tab 120 may also be referred to as a horizontal engaging member or portion alone and/or in combination with the passage 124. Again, in various embodiments, as exemplary illustrated in FIG. 3, when the cap 20 is an orthogonally shaped cap, the passages 124 may include four passages which may be designated 124*a*, 124*b*, 124*c*, and 124*d*. The passages 124 may be formed through the wall 92 and include an engaging surface or contacting surface 128. The contacting surface 128 may contact the portion of the locking finger 120, as discussed further herein. In various embodiments, the surface 128 may be formed entirely through the wall 92 to engage the locking finger 120.

With continuing reference to FIGS. 1-6, and additional reference to FIGS. 7 and 8 the locking tabs 120 and the receiving or locking passage 124 will be described in greater detail. It is understood by one skilled in the art that the discussion of a single one of the projections 120 and passages 124, as described herein, may refer to all of them and that the projections 120 and passages 124 may be substantially identical to one another. Accordingly each of the tabs 120, therefore, may be received in each of the recesses or receiving portions 124 to allow for engagement of a plurality of the caps 20, as discussed further here in.

Figure 7:
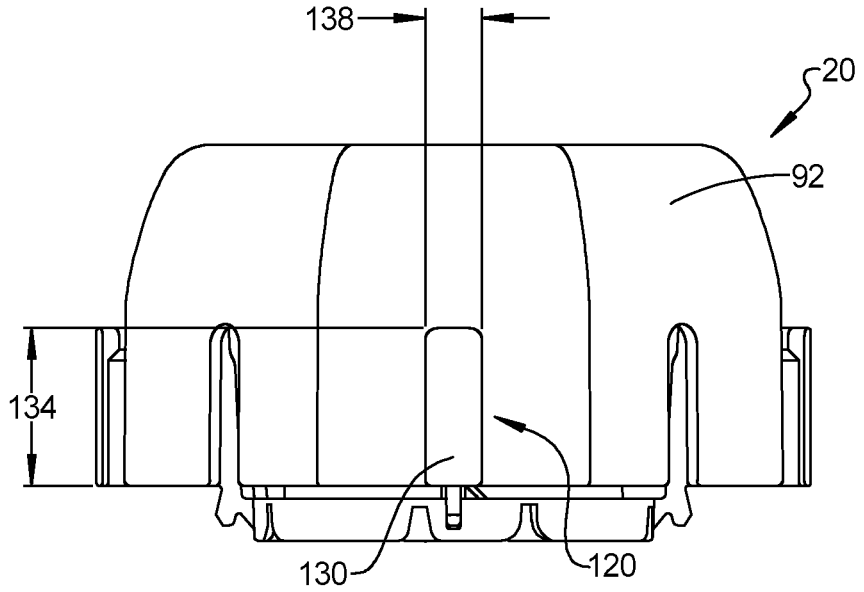
FIG. 7 is a third side elevation view of the cap, according to various embodiments.

Generally, with initial reference to FIG. 7, the projection 120 may include an outer wall or outwardly facing wall 130. The outwardly facing wall 130 may have a selected height 134 that is about 5 mm to about 10 mm, including about 6 mm to about 8 mm, and further including about 7.5 mm. Further, the outer wall 130 may include a width 138 that has a selected dimension that is about 1 mm to about 4 mm, further including about 2 mm to about 3 mm, and further including about 2.7 mm.

The receiving passage or opening 124 may have a height 140 that may be equivalent to or slightly greater than the height 134. In various embodiments, for example, the height 140 may include a height of about 5 mm to about 10 mm, further including about 6 mm to about 8 mm, and further including about 7 mm. Further, a width or opening dimension 144 between the two wall surfaces 128 of the passage 124 may have a passage dimension of 144. The passage dimension 144 may generally be less than the dimension 138 of the outer wall 130 to allow for or minimize a horizontal disengagement of the cap 20 from another cap, as discussed further herein. Accordingly, the dimension 144 may be less than dimension 138, and may generally be about 1 mm to about 3 mm.

Figure 8:
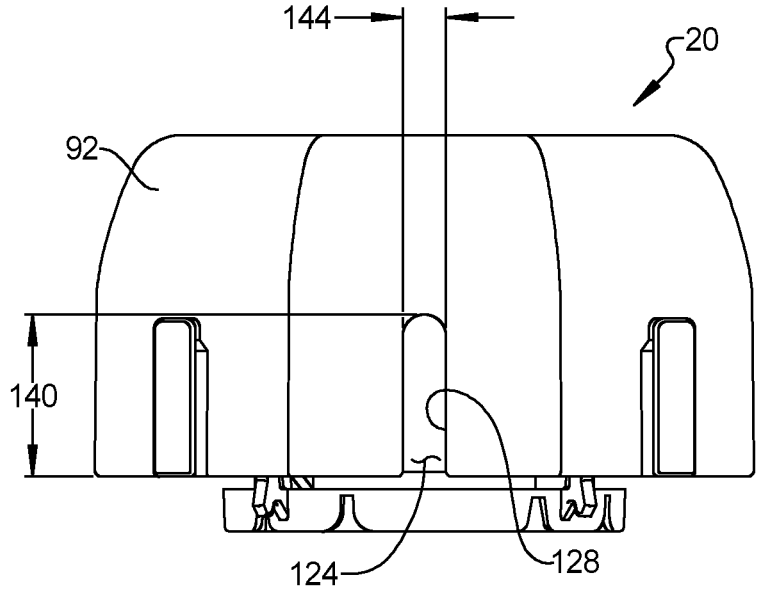
FIG. 8 is a fourth side elevation view of the cap, according to various embodiments.
Figure 9:
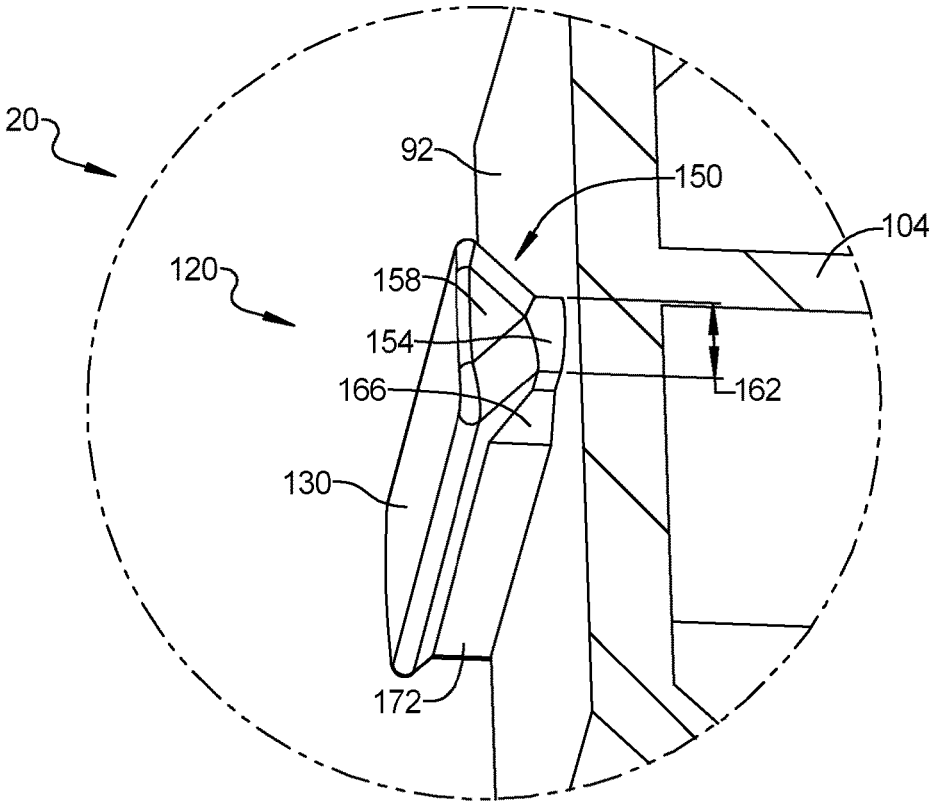
FIG. 9 is a detail view of a top portion of a horizontal engaging member, according to various embodiments.
Figure 10:
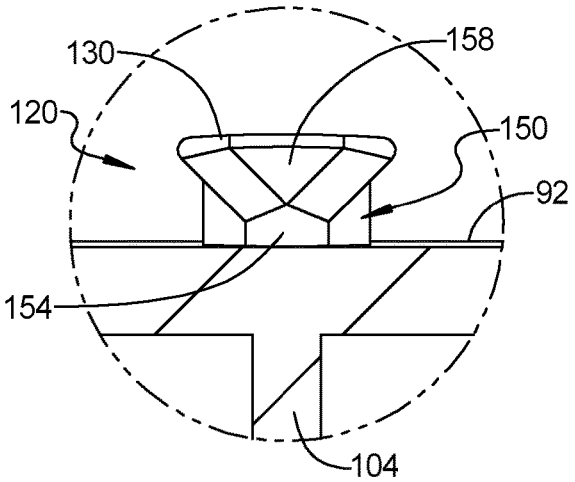
FIG. 10 is a detail view of a top portion of a horizontal engaging member, according to various embodiments.

With continuing reference to FIGS. 7 and 8 and additional reference to FIGS. 9, 10, 11, and 12 the locking or engaging projection 120 will be described in further detail. Within this reference to FIG. 9, the locking projection 120 includes the outer wall 130, as discussed above. The projection 120 extends from the outer wall 92 of the cap 20. The projection 120 may have a selected geometry, as illustrated in FIGS. 9 and 10 at a first or upper end 150 that is nearest to the top or upper surface 88 of the cap 20. The upper end 150 may be relative to any orientation to the cap 120, and is discussed herein and reference to the upper end is merely for clarity of the current discussion. The upper end 150 may include a generally "Y" shaped cross section having a first projection wall or portion 154 that extends from the outer wall 92. Extending from the projection 154 and tapering toward the outer wall surface 130 may be a second projection portion 158. The second projection portion 158 may include an outer or greater extent that is substantially equal to the dimension 138. The initial taper portion may be substantially equivalent to a dimension of the first projection 154 that may be or have a width 162. The width 162 may be any appropriate dimension, such as generally about 20% to about 80% of the width 138. This allows the dimension 162 to be about 0.2 mm to about 2 mm, according to various embodiments.

Further, the upper portion 150 may taper from an outer or distal surface that may be at the end of the projection 120 toward a flat or faceted wall surface 166. The upper portion 150 may include the upper tapered or curved surface 168 that may extend or transition to the upper facet 166. The projection 120 may further include a substantially vertical or flat wall surface or portion 172 which extends from the transition facet 166 to a terminal or lower end 176.

Figure 11:
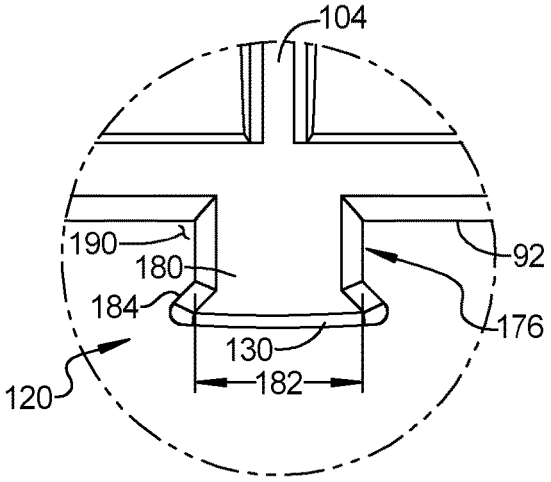
FIG. 11 is a detail view of a bottom portion of a horizontal engaging member.
Figure 12:
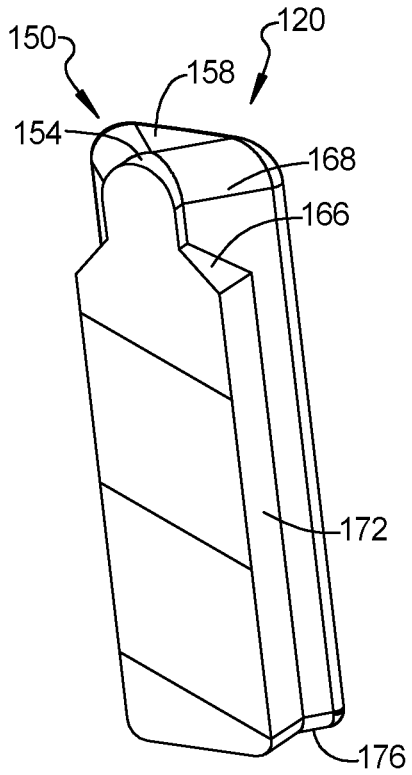
FIG. 12 is a detail cross-sectional prospective view of the horizontal engaging member take along line 12-12 in FIG. 3, according to various embodiments.

As illustrated in FIG. 11, the terminal second end 176 may have a generally "T" cross section or geometry. Generally the terminal end 176 may include a projection portion 180 that extends from the wall 92 substantially vertically or normal to the wall 92. A dimension 182 of the projection 180 may be substantially consistent from the wall 192 to a shortened tapered region 184 near the wall or outer surface 130. The dimension 182 may generally be about 60% to about 80% of the dimension 138 of the outer wall 130, as discussed above. Accordingly, the dimension 182 may in general be about 1.5 mm to about 3.5 mm.

The projection 120 may project from the wall 92 and include a receiving or engaging volume or area 190 that extends between the outer wall 92 and the surface 194 of the projection. Further, the upper end 150 may include a tapered region, as discussed above, to initiate contact and receiving within the passages 124, for engaging or connecting a plurality of the caps 20 together.

Figure 13:
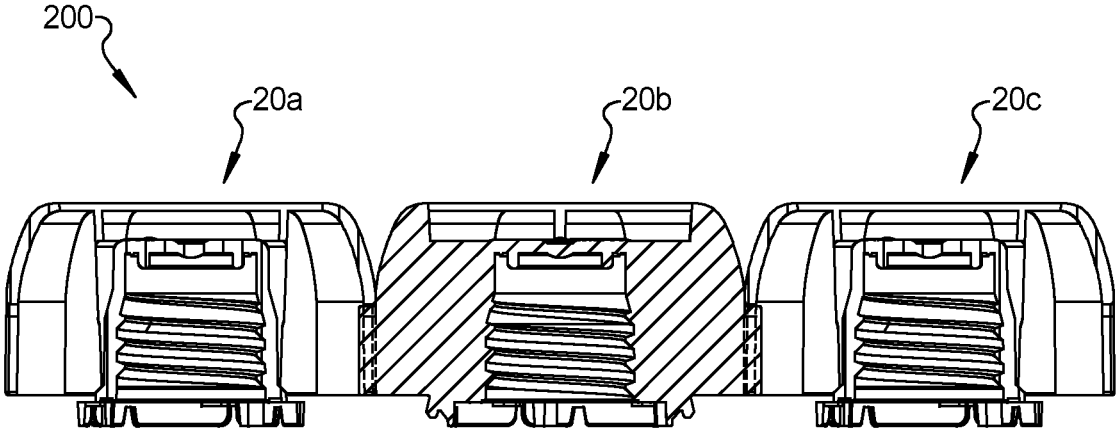
FIG. 13 is a partial cross-sectional view of a horizontal engagement pattern, according to various embodiments.
Figure 14:
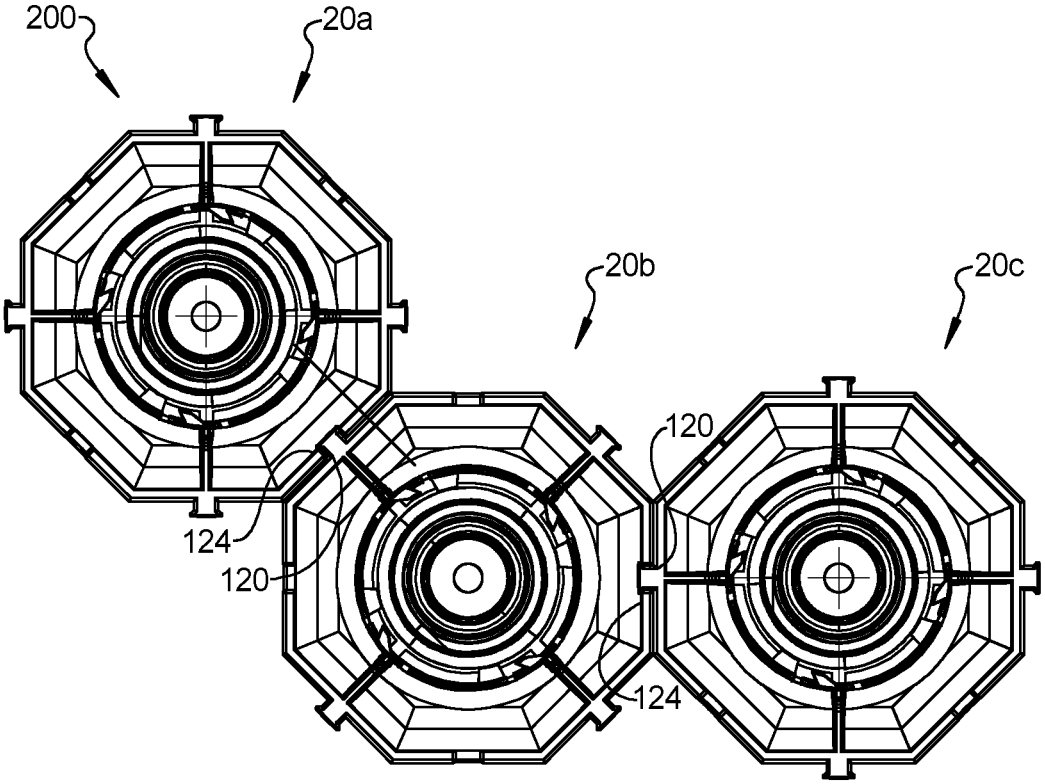
FIG. 14 is a top plan view of a horizontal engaging arrangement, according to various embodiments.

With continuing reference to FIGS. 1-12 and additional reference to FIGS. 13 and 14, a plurality of caps may include a first cap 20*a* a second cap 20*b* and third cap 20*c*. It is understood, however, that any appropriate number of the caps 20 may be interconnected to form a cap connection or group 200. The cap connection or group 200 may be interconnected with the projection 120 being received in the slots 124 of an adjacent cap. For example, the cap 20*a* may have a recess 124 that receives the projection 120 from the cap 20*b*. Thus, the two caps 20*a*, 20*b* may be interconnected. Further, the cap 20*b* may have a recess 124 that receives or engages a projection 120 from the third cap 20*c*. This allows the third cap 20*c* to be engaged or captured with the recess 124 and the cap 20*c* is connected to the cap 20*b*. Thus, as exemplary illustrated in FIGS. 13 and 14, the cap group 200 may be formed by interconnecting a plurality of the caps 20, such as three of the caps 20*a*, 20*b*, 20*c*. It is further understood that any appropriate number of the caps 20 may be interconnected and three is merely an exemplary for the current discussion. As illustrated, the cap group 200 may be referred to as a horizontal or planar cap group or connected cap configuration. Thus, the projection 120 and the recess 124 may allow caps to be connected in a planar manner.

Figure 15:
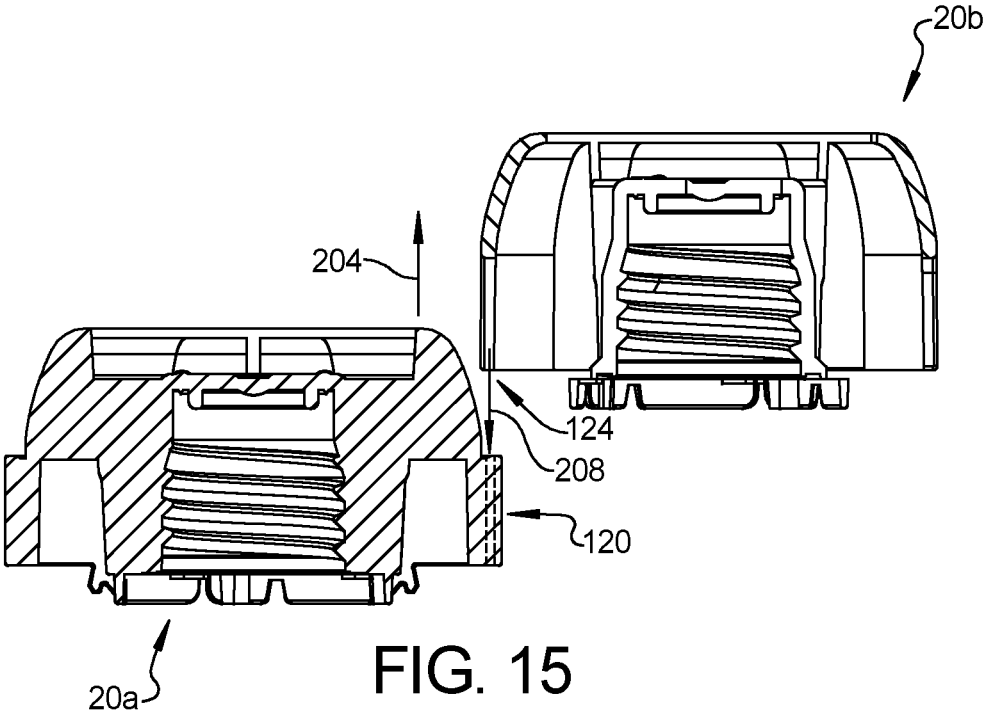
FIG. 15 is a detail view of an engagement process of a plurality of caps, according to various embodiments.

To engage the connection, as illustrated in FIGS. 13 and 14, the caps may be moved generally vertically relative to one another, as illustrated in FIG. 15. For example, the cap 20*a* may be moved in the direction of arrow 204 relative to the cap 20*b*. The projection 120 may be aligned with recess 124 and moved generally in the direction of arrow 204. Further, the cap 20*b* may also be moved in the direction of 208 after aligning the recess 124 generally with the projection 120. As discussed above, the two caps 20*a*, 20*b* may be moved relative to one another and the respective directions 204, 208 are merely exemplary.

Further the first end 150 of the projection 120 may assist in aligning the projection 120 within the recess 124 to assist in the engagement of the two caps 20*a*, 20*b* relative to one another. Thus, the first end 150 may assist in achieving an efficient and quick connection of the two caps 20*a*, 20*b*.

It is understood, however, that the recess 124 may also engage the projection 120 beginning or initiating at the second end 176. The opening 124, as discussed above, may extend over the projection 180 and the two caps 20*a* and 20*b* may be moved relative to one another to form or engage the two caps 20*a*, 20*b* relative to one another. This allows the caps to be horizontally connected with top and bottom sides on the same generally plane or they may be connected such that a top side is adjacent a bottom side.

As discussed above, the internal surface 128 of the passage 124 may have a selected dimension 144. The dimension 144 may frictionally engage the external wall or surface 172 of the projection 120. The frictional or interference engagement may provide the selected force to connect or hold a select number of the caps 20 relative to one another. The frictional or interference interaction may create or require a force of about 5 Newton (N) to about 30 N, including about 5 N to about 25 N, and further including about 15 N to about 20 N to separate one cap 20 from another cap 20 once connected or engaged with the dimension 144 frictionally engaging the external wall or surface 172 of the projection 120.

As discussed above, a plurality of the caps, such as three of the caps 20*a*-20*c*, may be assembled together substantially horizontally or on a plane. The caps may be interconnected by connecting the projection 130 into the recess or receiving hole 124, as discussed above. According the caps may have an edge-to-edge or side-to-side connection to form the substantially plainer or horizontal arrangement, as illustrated in FIG. 14. The caps may be formed into any appropriate geometry or shape, which may be, at least in part, defined or limited to the external geometry of the cap 20. As discussed above the cap 20 may be provided in an appropriate exterior geometry.

The cap 20 may further include a mechanism to allow for a vertical stacking of the plurality of the caps 20. As illustrated in FIG. 13, the horizontal stack substantially one high with several in a planar or horizontal arrangement relative to one another. In a selected embodiment or configuration, however, the caps may also be stacked vertically, such as on top of another. It is understood that the vertical stacking may be in addition to the horizontal connection and need not be only an alternative, and vice versa.

Figure 16:
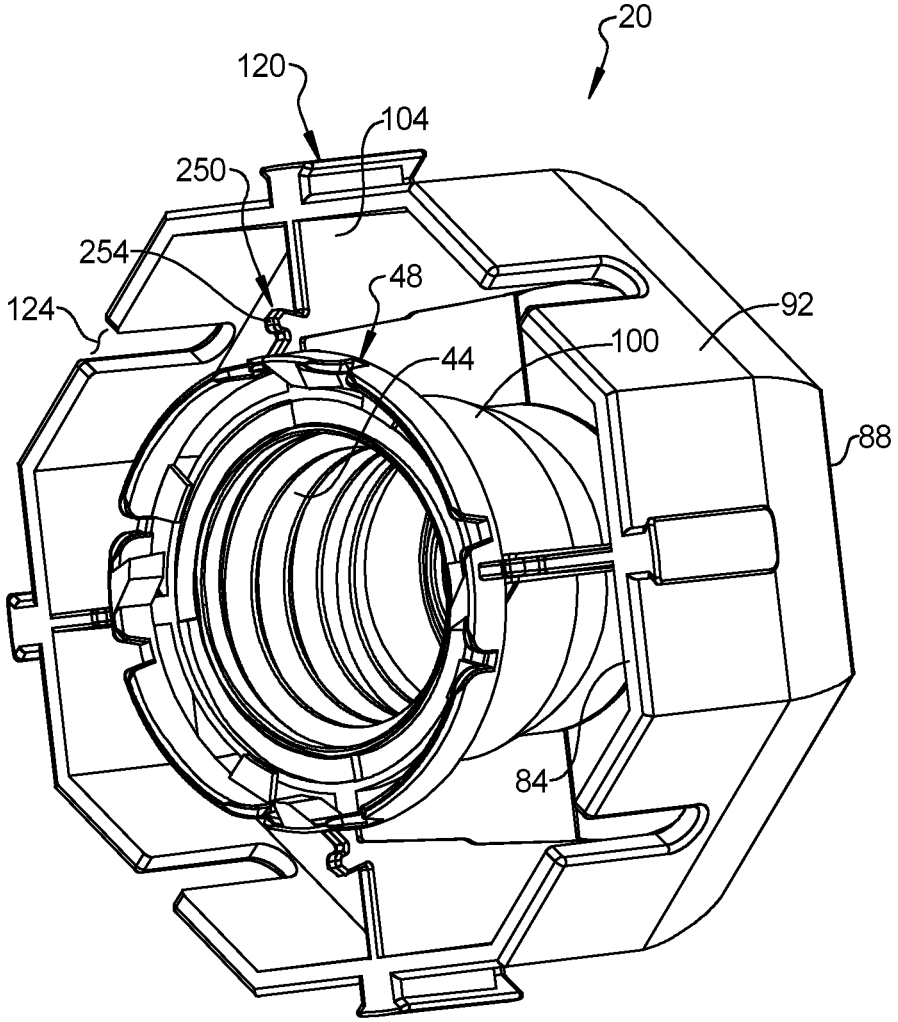
FIG. 16 is a bottom perspective view of the cap and a vertical engaging portion, according to various embodiments.
Figure 17:
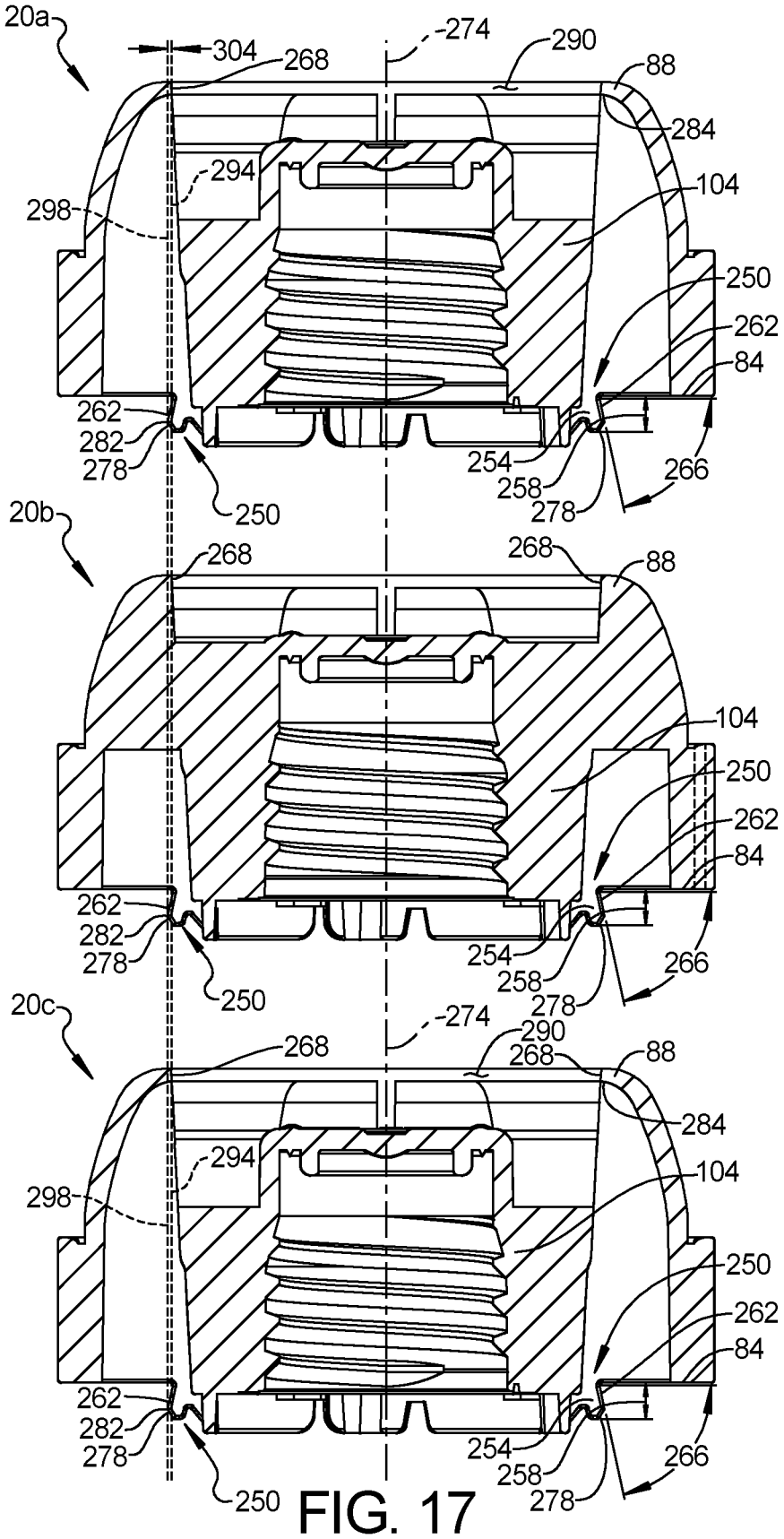
FIG. 17 is a cross-sectional environmental view of a vertical engaging pattern of caps, according to various embodiments.

With continuing reference to FIGS. 1-15, and further reference to FIGS. 16 and 17, the cap 20 may further include a mechanism to allow for a vertical stacking and engagement or connection. As discussed above the cap 20 may define or form internal threads 44 within a central region or portion 100. The sealing or tamper resistant or identification portion 48 may extend from the central region 100. The external wall 92 may further extend from the top surface or portion 88 to the bottom portion 84. Extending at or near the bottom portion 84, or generally at a plane relative there to, may be an engagement portion 250, which may also be referred to as a cap or cap top engaging or engagement portion.

The engagement portion 250 may include a finger or projection 254 that extends a distance 258 from the bottom surface 84. The engagement portion 250, including the finger 254, may resiliently deform, as discussed herein. The finger 254 defines an exterior or engaging surface 262 that may extend at an angle 266 relative to the bottom surface 84. The distance 258 and the angle 266 allow for engagement to an upper wall or edge 268 of the cap 20. As illustrated in FIG. 17, for example, the first cap 20*a* may include the engagement portion 250 that may engage the edge 268 at the top 88 of the second cap 20*b*. The second cap 20*b* may also include an engagement portion 250 to allow for engagement to a further cap, such as the cap 20*c*. Thus the engagement region 250 of the cap 20*b* may engage the edge 286 at the upper edge or rim 88 of the third cap 20*c*. Thus the caps 20*a*-20*c* may also be stacked vertically, such as substantially along an axis 274.

The angle 266 may be selected to allow for the deflection and engagement to the edge 268 of a respective cap. The angle 266 may be about 76° (degrees) to about 82°, further including about 77 degrees to about 79 degrees, and further including about 78 degrees. The surface 262 may also have an angle 266' relative to the long axis 274 of the cap 20. The angle 266' is complimentary to the angle 266. Thus, the angle 266' may be about 8° to about 14°, about 11° to about 13°, and further including about 12°. The discussion of the angle 266 herein, therefore, is understood to relate to both the angles 266, 266'.

The angle 266 may be selected such that the surface 262 may be deflected generally toward the axis 274 when engaging the edged 268 of a respective cap portion. The finger portion 254 may, thereafter, provided a resilient deformation a non-classic deformation of the finger 254 such that the surface 262 that expands against and/or provides pressure against the edge 268 of a respective cap. Thus the caps may be stacked substantially vertically, such as along the axis 274.

The engagement region 250 may be formed near the bottom portion 84 of the respective caps 20. Thus, the bottom portion of the respective caps may be engaged toward or to a top portion 88 of another cap. The surface 262 may deflect or move to allow for a positive engagement of one cap to another. The positive engagement may include a snap fit, an interference fit, or other appropriate fit. The engagement portion 250 may also be referred to as a vertical engaging member or portion alone and/or in combination with the edge or passage 268.

For example, as illustrated in FIG. 17, the finger 254 includes the surface 262 and a second surface portion 278. Between the surface 262 and the surface 278 may be a bulge or edge 282 that may be moved past a bottom edge or portion 284 of the surface 268. Thus, the finger portion 254 may provide a snap fit to respective of the caps 20. Further, the external edge 262 may also provide a friction or an interference fit with respective caps 20. Accordingly, the respective caps may be positively engaged to another of the cap with a friction fit, a snap fit, or other appropriate connection.

As illustrated in FIG. 17, the locking or engaging portion 250 includes the respective surfaces 262 and 278 and projection or point 282 there between. The inner surface 268 of the upper edge 88, which may define an opening or bore 290. The bore 290 having the edge 268 may define an axis or line 294. Each of the caps 20 may have a substantially equivalent geometry such that the line 294 extending from the edge 268 may be aligned with the edge 268 of a different cap. The point or transition 282 may also define a line 298. The edge or point 282 may be aligned with an edge or point 282 of a different or adjacent cap define the line 298. The line 294, 298 may be spaced a part by a distant 304. The distance 304 may provide for the interference or snap fit between the respective ones with lids such as the lid 20*a*, 20*b*. The distance 304 may be about 0.001 mm to about 1 mm, including about 0.01 mm to about 0.5 mm. Thus, the angle 266 may assist in defining the distance of 304 to allow for the engagement.

Further, as illustrated in FIG. 17, the engagement portions 250 may generally extend from and/or be formed with the spokes or transfer portions 104. Thus, the engagement or projection portions 250 may be reinforced or provided with the spokes 104.

In light of the above, therefore, the caps 20 may be interconnected in a selected manor such as substantially horizontally (e.g. as illustrated in FIG. 14) and/or vertically (e.g. as illustrated in FIG. 17). The caps 20, therefore, may be provided to close or seal the container 28 and/or be interconnect. The caps 20 allow for a multiple or plurality of uses, such as one not being used as a cap or sealing portion for container 28.

The caps 20, especially with a plurality thereof, may be used for multiple purposes. The caps 20 may be used to seal and/or close a container, as discussed above. The caps 20 may also be used to interconnect in a vertical or horizontal manner. For example, after being removed from a container the caps may be interconnected, such as by a child. The interconnection may allow for play by the child to design and build various shapes and connection. The shape of the cap 20 may allow for selected configurations, such as allowing for shapes due to the selected facets of the cap 20. It is understood, however, that a selected number of facets may be selected.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A cap for a container having multiple purposes, comprising:

a container engaging portion;

an outer wall surrounding the container engaging portion and having an inner surface and an outer surface;

a connection member extending radially from the outer surface of the outer wall having a projection portion with a projection dimension and a transverse portion with a transverse dimension; and a passage formed entirely through the outer wall from the inner surface to the outer surface having a passage dimension between opposed surfaces connecting the inner surface to the outer surface, wherein the passage dimension is less than the transverse dimension and forms a friction engagement with the projection portion;

wherein the cap has an outer major diameter.

2. The cap of claim 1, wherein the transverse portion of the connection member is within the outer major diameter.

3. The cap of claim 1, wherein the outer wall includes a plurality of facets that surrounds the container engaging portion.

4. The cap of claim 3, wherein the plurality of facets includes 8 facets such that the cap defines an octagonal shape.

5. The cap of claim 1, further comprising:

a cap engaging member extending axially and generally transverse to the projection portion.

6. The cap of claim 5, further comprising:

a plurality of spokes extending from the container engaging portion to the outer wall.

7. The cap of claim 6, wherein the cap engaging member includes a plurality of cap engaging members, wherein each cap engaging member extends from one spoke of the plurality of spokes.

8. The cap of claim 5, wherein the cap engaging member includes a surface that extends at an angle of about 10 degrees to about 14 degrees from a longitudinal axis of the cap.

9. The cap of claim 5, further comprising:

an upper opening having a first distance extending from a center of the cap;

wherein the cap engaging member includes a surface that extends a second distance from the center of the cap that is at least 0.01 millimeters greater than the first distance.

10. The cap of claim 5, wherein the cap engaging member is configured to resiliently deform.

11. The cap of claim 1, wherein the projection portion tapers toward a terminal end.

12. The system of claim 11, further comprising:

a tamper evident portion formed with the cap to engage at least a portion of the fitment to lock the cap to the fitment.

13. The cap of claim 1, wherein the projection portion includes a substantially Y-shaped end surface.

14. A system, comprising:

the cap of claim 1, a container;

a fitment sealed to the container having a cap engaging portion configured to engage the container engaging portion.

15. A cap for a container, comprising:

a container engaging portion defining an internal thread;

an outer wall extending from a top edge to a bottom edge;

a spoke member extending between the container engaging portion and the outer wall;

a horizontal cap adjoining portion, including:

a connection member extending radially from the outer wall having a projection portion with a projection dimension and a transverse portion with a transverse dimension, wherein the transverse dimension is greater than the projection dimension; and a passage formed through the outer wall having a passage dimension between opposed surfaces, wherein the passage dimension is less than the transverse dimension and forms a friction engagement with the projection portion; and a vertical cap adjoining portion including a connecting finger extending generally to or away from the bottom edge;

wherein the cap has an outer major diameter;

wherein the projection portion includes a generally Y-shaped end nearer the top edge than the bottom edge.

16. The cap of claim 15, wherein the all of the container engaging portion, the outer wall, the spoke member, the horizontal cap adjoining portion, and the vertical cap adjoining portion are formed as one member.

17. The cap of claim 15, further comprising:

an opening formed within the top edge and defined by the outer wall.

18. A cap for container, comprising:

a container engaging portion defining an internal thread;

an outer wall extending from a top edge to a bottom edge;

a spoke member extending between the container engaging portion and the outer wall;

a horizontal cap adjoining portion, including;

a connection member extending radially from the outer wall having a projection portion with a projection dimension and a transverse portion with a transverse dimension, wherein the transverse dimension is greater than the projection dimension; and a passage formed through the outer wall having a passage dimension between opposed surfaces, wherein the passage dimension is less than the transverse dimension and forms a friction engagement with the projection portion; and a vertical cap adjoining portion including a connecting finger extending generally to or away from the bottom edge;

wherein the cap has an outer major diameter;

wherein the vertical cap adjoining portion includes a finger having a surface that extends at an angle of about 74 degrees to about 78 degrees relative to the bottom edge.

19. The cap of claim 18, wherein the finger is resiliently deformable.

* * * * *